US007539442B2

(12) United States Patent
Nagatomo et al.

(10) Patent No.: US 7,539,442 B2
(45) Date of Patent: May 26, 2009

(54) CHARGING UNIT, PROCESS UNIT INCLUDING THE SAME, AND IMAGE FORMING APPARATUS INCLUDING THE SAME

(75) Inventors: Yuji Nagatomo, Osaka (JP); Tetsumaru Fujita, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 11/759,051

(22) Filed: Jun. 6, 2007

(65) Prior Publication Data

US 2007/0280735 A1 Dec. 6, 2007

(30) Foreign Application Priority Data

Jun. 6, 2006 (JP) ..... 2006-157375
Mar. 13, 2007 (JP) ..... 2007-063971

(51) Int. Cl.
*G03G 15/02* (2006.01)

(52) U.S. Cl. ..... 399/174; 399/175; 399/176; 399/50; 361/221

(58) Field of Classification Search ..... 399/174, 399/175, 176; 361/212, 221, 225
See application file for complete search history.

(56) References Cited

U.S. PATENT DOCUMENTS 5,999,760 A * 12/1999 Suzuki et al. ..... 399/45
7,054,574 B2 * 5/2006 Facci et al. ..... 399/89
2004/0202487 A1 * 10/2004 Sakai et al. ..... 399/50
2007/0047983 A1 * 3/2007 Itoh et al. ..... 399/33
2007/0280735 A1 12/2007 Nagatomo et al.

FOREIGN PATENT DOCUMENTS

JP 62-202445 7/1994
JP 09-311528 12/1997
JP 2001-166564 6/2001
JP 2001-348443 12/2001

OTHER PUBLICATIONS

U.S. Appl. No. 12/020,089, filed Jan. 25, 2008, Sakagawa, et al.

(Continued)

*Primary Examiner*—Ali Alavi
*Assistant Examiner*—Evan Dzierzynski
(74) *Attorney, Agent, or Firm*—Oblon, Spivak, McClelland, Maier & Neustadt, P.C.

(57) ABSTRACT

A charging unit available in a process unit detachably attached to an image forming apparatus includes a charging member configured to uniformly charge a surface of an image carrying member while contacting the image carrying member, and a charge bias applying unit configured to apply a charge bias superimposing a direct current voltage on an alternating current voltage to the charging member. The alternating current voltage satisfies a relational expression of "$Vpp \times 0.4/t \leqq 8.8 \times 10^3$", "Vpp" representing a peak-to-peak voltage of the alternating current voltage in the charge bias, and "t" representing a time period from a first point of a swing of a wave component starting to swing by a large amount to a same polarity as the direct current voltage of the charge bias to a second point of the swing of the wave component reaching approximately 80% of an amplitude of the wave component.

20 Claims, 5 Drawing Sheets

OTHER PUBLICATIONS

U.S. Appl. No. 12/023,544, filed Jan. 31, 2008, Sakagawa, et al.
U.S. Appl. No. 12/021,630, filed Jan. 29, 2008, Fujita, et al.
U.S. Appl. No. 12/050,529, filed Mar. 18, 2008, Sakagawa, et al.
U.S. Appl. No. 12/178,108, filed Jul. 23, 2008, Fujita, et al.
U.S. Appl. No. 12/187,021, filed Aug. 6, 2008, Shono, et al.

* cited by examiner

CHARGING UNIT, PROCESS UNIT INCLUDING THE SAME, AND IMAGE FORMING APPARATUS INCLUDING THE SAME

CROSS REFERENCE TO RELATED APPLICATIONS

The present application claims priority to Japanese patent application no. 2006-157375, filed in the Japan Patent Office on Jun. 6, 2006, and Japanese patent application no. 2007-063971, filed in the Japan Patent Office on Mar. 13, 2007, the disclosures of each of which are incorporated by reference herein in their entirety.

BACKGROUND OF THE INVENTION

1. Field of the Invention

The present invention relates to a charging unit that applies a charge bias for effectively charging a target member, a process unit including such a charging unit, and an image forming apparatus including such a charging unit. More particularly, the present invention relates to a charging unit that effectively charges an image carrying member with a given charge bias while being held in contact with the image carrying member, a process unit including such a charging unit therein, and an image forming apparatus including such a charging unit therein.

2. Discussion of the Related Art

Related art charging units generally include a charging member such as a charging brush member or a charging roller. Such related art charging units apply a given charge bias to the charging member so that the charging member can uniformly charge a surface of a target member that is disposed opposite to and in contact with the charging member.

A well known charge bias generally employed to apply to the charging member is an alternating current (AC) bias superimposed by a direct current (DC) bias.

The surface of the target member, before charging, may keep residual toner supplied onto an electrostatic latent image during a previous image forming operation. Specifically, when the residual toner for an electrostatic latent image still remains on the surface of the target member before charging, the potential deviation of the target member may be increased.

In such a case, a charge bias including a DC voltage cannot sufficiently remove the potential deviation. Unfortunately, this can easily cause a charging nonuniformity.

On the contrary, by repeating the charge and discharge during a short time period according to a potential deflection of an alternating component, the AC bias superimposed by the DC bias can reduce a production of such charging nonuniformity or potential nonuniformity.

However, such a charging unit can easily generate excessively charged parts on the target member. This may cause white spots or white deletions in which no image is formed.

SUMMARY OF THE INVENTION

Exemplary aspects of the present invention have been made in view of the above-described circumstances.

Exemplary aspects of the present invention provide a charging member that can effectively reduce or prevent excessive charging on local parts on a surface of an image carrying member.

Other exemplary aspects of the present invention provide a process unit that includes the above-described charging member to uniformly charge the image carrying member.

Other exemplary aspects of the present invention provide an image forming apparatus that includes the above-described charging member to uniformly charge the image carrying member.

In one exemplary embodiment, a charging member apparatus includes a charging member configured to uniformly charge a surface of a target member while contacting the target member, and a charge bias applying unit configured to apply a charge bias superimposing a direct current voltage on an alternating current voltage to the charging member. The alternating current voltage satisfies a relational expression of "$Vpp \times 0.4/t \leqq 8.8 \times 10^3$", where "Vpp" represents a peak-to-peak voltage of the alternating current voltage in the charge bias, and "t" represents a time period from a first point of a swing of a wave component starting to swing by a large amount to a same polarity as the direct current voltage of the charge bias to a second point of the swing of the wave component reaching approximately 80% of an amplitude of the wave component.

The charging member may include one of a charging brush member configured to charge the target member by contacting a plurality of electrically conductive fibrous members arranged in a standing manner mounted on a surface of a base member thereof to the target member, a charging roller configured to charge the target member by contacting an elastic surface of a roller part thereof to the target member, a charging sheet configured to charge the target member by contacting a surface thereof to the target member, and a charging blade configured to charge the target member by contacting a surface thereof to the target member.

The charge bias applying unit may be configured to apply to the charging member the alternating current voltage satisfying a relational expression of "$3.3 \times 10^2 \leqq Vpp \times 0.4/t \leqq 8.8 \times 10^3$."

The charge bias applying unit may be configured to apply to the charging member the alternating current voltage satisfying a relational expression of "$10 < (D/100 - f \times t/1000) \times 100 < 80$", with "D" representing a duty of the wave component swinging by a large amount to the same polarity as the direct current voltage of the charge bias, and "f" representing a frequency of the alternating current voltage.

The peak-to-peak voltage "Vpp" may be set in a range from approximately 200V to approximately 1200V.

The time period "t" may be set in a range from approximately 0.05 msec to approximately 1.5 msec.

The frequency "f" may be set in a range from approximately 10 Hz to approximately 3000 Hz.

The duty "D" may be set in a range from approximately 25% to approximately 85%.

The charging member may be configured to include the charging brush member, and the charge bias applying unit may be configured to apply to the charging brush member the alternating current voltage satisfying a relational expression of "$Vpp \times 0.4/t \leqq 7.3 \times 10^3$."

The charging brush member may include at least one fibrous member having a volume resistivity in a range from approximately $1.0 \times 10^3$ Ω·cm to approximately $1.0 \times 10^7$ Ω·cm.

The charging brush member may include at least one fibrous member having a thickness in a range from approximately 0.7 denier to approximately 5 denier.

The charging brush member may include a charging brush roller having a plurality of fibrous members arranged in a standing manner mounted on a surface of a rotary shaft member.

The target member and the charging brush member may be arranged so that a leading edge of at least one fibrous member of the charging brush member contacts the target member with an amount of inroads from approximately 0.1 mm to approximately 1.4 mm.

The charging member may include the charging roller.

The charging roller may include a volume resistivity on a surface of a roller portion thereof in a range from approximately $1\times10^4$ Ω·cm to approximately $1\times10^9$ Ω·cm.

The charging roller may include a JIS-A hardness on a surface of a roller portion thereof in a range from approximately 30 degrees to approximately 70 degrees.

The charging roller may include a surface roughness on a surface of a roller portion thereof in a range from approximately 1 μm to approximately 40 μm.

Further, in one exemplary embodiment, a process unit includes an image carrying member configured to carry an image on a surface thereof, a charging unit integrally mounted to the process unit together with the image carrying member, which includes a charging member configured to uniformly charge a surface of the image carrying member while contacting the image carrying member, and a charge bias applying unit configured to apply a charge bias superimposing a direct current voltage on an alternating current voltage to the charging member. The alternating current voltage satisfies a relational expression of "$Vpp\times0.4/t\leqq8.8\times10^3$", where "Vpp" represents a peak-to-peak voltage of the alternating current voltage in the charge bias, and "t" represents a time period from a first point of a swing of a wave component starting to swing by a large amount to a same polarity as the direct current voltage of the charge bias to a second point of the swing of the wave component reaching approximately 80% of an amplitude of the wave component.

Further, in one exemplary embodiment, an image forming apparatus includes an image carrying member configured to carry an image on a surface thereof, a charging unit configured to charge the image carrying member, which includes a charging member configured to uniformly charge a surface of the image carrying member while contacting the image carrying member, and a charge bias applying unit configured to apply a charge bias superimposing a direct current voltage on an alternating current voltage to the charging member. The alternating current voltage satisfies a relational expression of "$Vpp\times0.4/t\leqq8.8\times10^3$", where "Vpp" represents a peak-to-peak voltage of the alternating current voltage in the charge bias, and "t" represents a time period from a first point of a swing of a wave component starting to swing by a large amount to a same polarity as the direct current voltage of the charge bias to a second point of the swing of the wave component reaching approximately 80% of an amplitude of the wave component.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
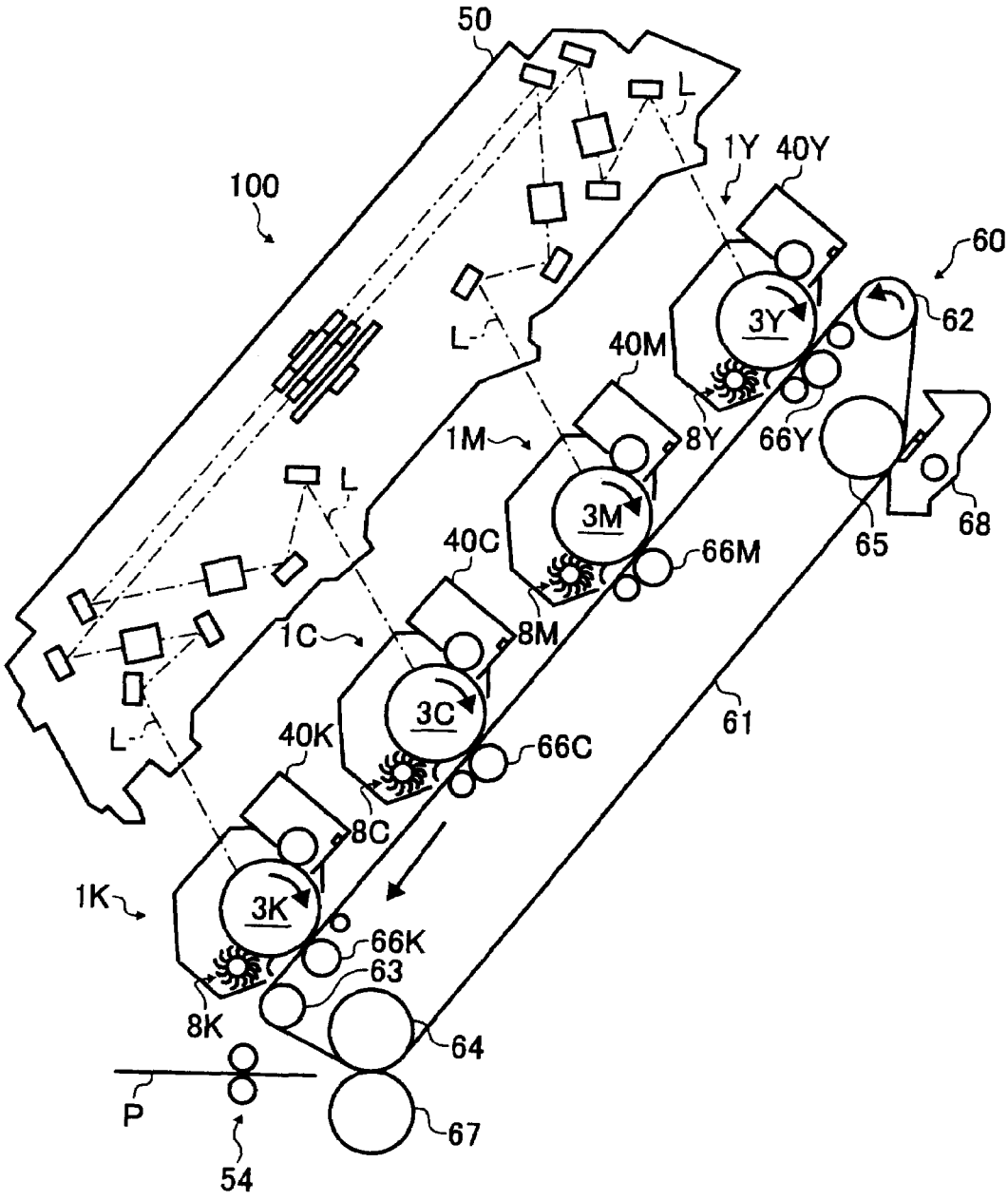
FIG. 1 is a schematic configuration of a main portion of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a schematic configuration of an electrophotographic color laser printer 100 according to an exemplary embodiment of the present invention is described.

The electrophotographic color laser printer 100 serves as an image forming apparatus according to a first exemplary embodiment of the present invention.

Hereinafter, the electrophotographic color laser printer 100 is referred to as a "printer 100."

In FIG. 1, the printer 100 includes four process units 1Y, 1M, 1C, and 1K, an optical writing unit 50, a pair of registration rollers 54, and a transfer unit 60.

The four process units 1Y, 1M, 1C, and 1K are cartridge type units and can integrally include image forming components therein for forming corresponding color toner images. The process units 1Y, 1M, 1C, and 1K include respective colors of toners, for example, yellow (Y), magenta (M), cyan (C), and black (K).

The suffixes provided to respective components are for indicating the color of toner used therefor.

The optical writing unit 50 includes light sources including four laser diodes for yellow, magenta, cyan, and black toner images, a polygon mirror, a polygon motor for rotating the polygon mirror, f-theta lens, other lenses, reflection mirrors, and so forth.

Respective laser light beams L that are emitted by the above-described laser diodes reflect on one of the surfaces of the polygon mirror. The reflected laser light beams L are deflected according to rotations of the polygon mirror and reach a corresponding one of four photoconductor drums 3Y, 3M, 3C, and 3K, which will be described below. The laser light beams L emitted by the laser diodes may expose respective surfaces of the four photoconductor drums 3Y, 3M, 3C, and 3K.

The process units 1Y, 1M, 1C, and 1K include photoconductor drums 3Y, 3M, 3C, and 3K that serve as latent image carrying member, developing units 40Y, 40M, 40C, and 40K corresponding to the respective photoconductor drums 3Y, 3M, 3C, and 3K, charging units 8Y, 8M, 8C, and 8K, and so forth.

The photoconductor drums 3Y, 3M, 3C, and 3K include a raw tube e.g., an aluminum tube, covered by an organic photoconductive layer. The photoconductor drums 3Y, 3M, 3C, and 3K are rotated by a drive unit (not shown) at a predetermined linear velocity in a clockwise direction in FIG. 1. Then, based on image data that is sent from a personal computer (not shown), the optical writing unit 50 emits the modulated laser light beams L to irradiate the photoconductor drums 3Y, 3M, 3C, and 3K for forming respective electrostatic latent images.

Figure 2:
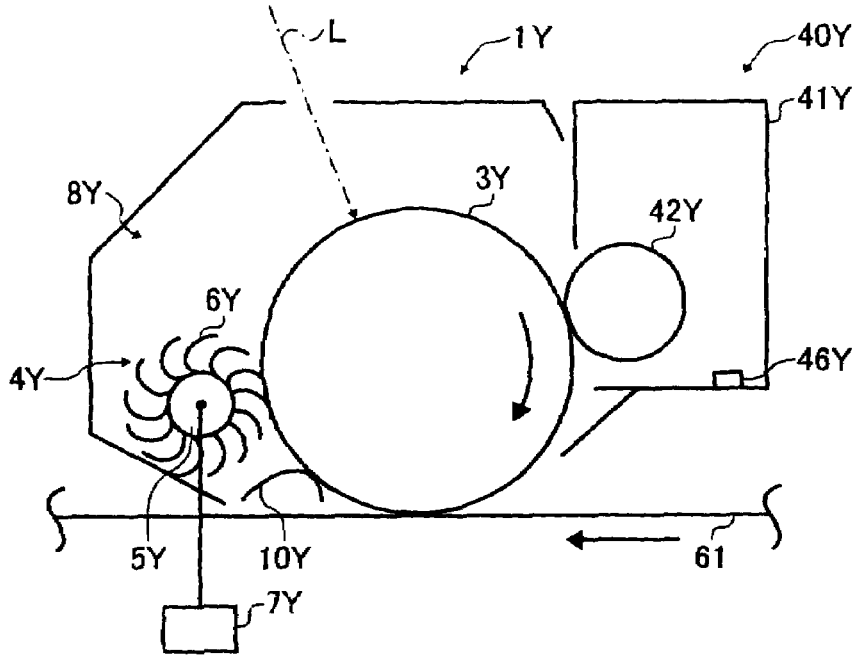
FIG. 2 is a schematic structure of a process unit of the image forming apparatus of FIG. 1, including a charging unit according to an exemplary embodiment of the present invention.

Referring to FIG. 2, a schematic configuration of the process unit 1Y for forming yellow toner images is described, together with the transfer unit 60 and an intermediate transfer belt 61.

Since the four process units 1Y, 1M, 1C, and 1K have the structure and function identical to each other, FIG. 2 is focused on the process unit 1Y for yellow toner images.

In FIG. 2, the process unit 1Y for yellow toner images includes the photoconductor drum 3Y, a charging unit 8Y, a discharge lamp (not shown), the developing unit 40Y, and other image forming components. The above-described image forming components are integrally mounted to a common unit casing or housing to be detachable with respect to a main body of the printer 100.

The photoconductor drum 3Y serves as an image carrying member for carrying an electrostatic latent image for yellow toner image, and is a target member to be charged by the charging unit 8Y.

The photoconductor drum 3Y includes a drum or cylinder shape having a diameter of 24 mm, for example. Specifically, the photoconductor drum 3Y has a conductive base member including an aluminum tube and a photoconductive layer including negative electric organic photoconductor (OPC) covered around the conductive base member. The photoconductor drum 3Y is rotated by a drive unit (not shown) at a linear velocity of approximately 124 mm/sec in a clockwise direction in FIG. 2.

The charging unit 8Y of FIG. 2 includes a charging brush roller 4Y, a rotary shaft member 5Y, and a plurality of conductive fibrous members 6Y.

The rotary shaft member 5Y and the plurality of conductive fibrous members 6Y form the charging brush roller 4Y that serves as a charging member.

The rotary shaft member 5Y is formed by a metallic material that can be rotatably born by a bearing (not shown).

The plurality of conductive fibrous members 6Y are arranged in a standing manner on a surface of the rotary shaft member 5Y.

While a drive unit (not shown) rotates the charging brush roller 4Y about an axis of the rotary shaft member 5Y, respective tips of the plurality of conductive fibrous members 6Y slidably contact the photoconductor drum 3Y.

The rotary shaft member 5Y is connected to a charge bias applying unit 7Y including a power source and wires so that a charge bias that includes an AC bias voltage superimposed by DC bias voltage can be applied to the charging brush roller 4Y.

Specifically, the charging brush roller 4Y, the drive unit (not shown) for driving the charging brush roller 4Y, and the charge bias applying unit 7Y form the charging unit 8Y of the printer 100 so that the surface of the photoconductor drum 3Y can be uniformly charged. The printer 100 is controlled to discharge between the plurality of conductive fibrous members 6Y of the charging brush roller 4Y and the photoconductor drum 3Y so as to uniformly charge the surface of the photoconductor drum 3Y to a negative polarity.

On the uniformly charged surface of the photoconductor drum 3Y for yellow toner image, the above-described optical writing unit 50 optically scans and forms an electrostatic latent image for a yellow toner image on the surface of the photoconductor drum 3Y. The electrostatic latent image for yellow color is developed to a yellow toner image by the developing unit 40Y.

The developing unit 40Y for developing yellow color images includes a casing 41Y and a developing roller 42Y.

The developing roller 42Y is disposed exposing a part of its surface through an opening arranged on the casing 41Y. The developing roller 42Y includes a developing sleeve formed by a non-magnetic pipe that is rotated by a drive unit (not shown), and a magnet roller (not shown) that is arranged in a hollow portion of the developing sleeve and is controlled not to be rotated with the developing sleeve.

The casing 41Y accommodates yellow developer (not shown) including magnetic carriers and yellow toner for negative charging.

While being agitated by an agitating and conveying unit including a screw member (not shown) and frictionally charged to a negative polarity, the yellow toner is attracted by a magnetic force of the magnet roller of the developing roller 42Y in rotation and conveyed to a surface of the developing sleeve. When the yellow toner on the developing sleeve passes a position opposite to a development doctor (not shown) according to rotations of the developing roller 42Y, the development doctor may regulate the layer thickness of the yellow toner. After the regulation of the layer thickness has been conducted, the yellow toner is conveyed to an image formation region opposite to the photoconductor drum 3Y.

In the image formation region, a development potential is provided between the developing sleeve to which a negative development bias is output from a power source (not shown) and the electrostatic latent image formed on the photoconductor drum 3Y. The development potential may cause an action of electrostatically transferring the negatively charged yellow toner from the developing sleeve to the electrostatic latent image on the photoconductor drum 3Y. In addition, a non-development potential is provided between the developing sleeve and a uniformly charged portion or background portion of the photoconductor drum 3Y so that the non-development potential may cause an action of electrostatically transferring the negatively charged yellow toner from the background portion to the developing sleeve.

By the action of the development potential, the yellow toner on the developing sleeve transfers from the developing sleeve to the electrostatic latent image on the photoconductor drum 3Y. According to this transfer, the electrostatic latent image is developed to a yellow toner image.

According to the development of the yellow toner image, the developer for yellow color may contain a lesser amount of yellow toner. Such developer for yellow color is returned to the casing 41Y as the development sleeve rotates. In addition, the yellow toner image on the photoconductor drum 3Y is transferred onto the intermediate transfer belt 61 of the transfer unit 60, which is later described.

A toner density sensor 46Y includes a permeability sensor and is fixedly mounted on a bottom plate of the casing 41Y so as to output a voltage according to the magnetic permeability of the developer for yellow color accommodated in the casing 41Y.

The magnetic permeability of the developer for yellow color shows a preferable relation with respect to the toner density of the developer. Therefore, the toner density sensor 46Y may output a voltage according to the density of yellow toner. The value of this output voltage is sent to a toner supply control unit (not shown).

The toner supply control unit includes a storing unit such as a random access memory or RAM so as to store Vtref for yellow toner, which is a target voltage value output from the toner density sensor 46Y, as well as other Vtref data for magenta, cyan, and black toners obtained in the same way as the Vtref for yellow toner.

The developing unit 40Y for yellow toner compares the voltage value output by the toner density sensor 46Y and Vtref for yellow toner. Then, the developing unit 40Y may cause a yellow toner density control unit (not shown) to drive by a period of time according to the result of the comparison so as to supply additional yellow toner into the developing unit 40Y.

By controlling the yellow toner density control unit as described above, an appropriate amount of yellow toner may be supplied to the developer having less yellow toner density so that the yellow toner density in the developer in the developing unit 40Y can be maintained in its given range.

The same toner density control may be conducted for the other developing units of magenta, cyan, and black.

In an exemplary embodiment of the present invention, a developing unit that accommodates a two-component developer including toner and magnetic carrier is used. However, a developing unit that can be used for the present invention is not limited to the developing unit for the two-component developer. Alternatively, a developing unit that accommodates a one-component developer mainly including toner can be applied to the present invention.

A yellow toner image formed on the photoconductor drum 3Y may be transferred onto the intermediate transfer belt 61 at a primary transfer nip at which the photoconductor drum 3Y and the intermediate transfer belt 61 contact each other.

After passing through the primary transfer nip, the photoconductor drum 3Y may still hold residual toner that has not been transferred onto the intermediate transfer belt 61.

The process unit 1Y of the printer 100 according to an exemplary embodiment of the present invention employs a so-called "cleaner-less system." The cleaner-less system can perform an image forming process without using a dedicated unit for collecting residual toner from the surface of an image carrying member such as the photoconductor drum 3Y. In other words, the cleaner-less system does not require a toner collecting unit or a cleaning unit. Specifically, after removing residual toner from the surface of a latent image carrying member, the cleaner-less system conveys and collects the residual toner to a toner container or to the developing unit for reusing, without causing the residual toner to return to the latent image carrying member.

Details of such a cleaner-less system are described below.

There are generally three types of cleaner-less systems, which are spread type, catch-and-release type, and combination type that uses both the spread type and catch-and-release type.

The spread type cleaner-less system uses a toner spreading member such as a brush for slidably contacting the latent image carrying member. With the spread type cleaner-less system, the toner spreading member may scrape and/or spread residual toner on the latent image carrying member to reduce adherence of the residual toner with respect to the latent image carrying member. The residual toner remaining on the surface of the latent image carrying member is then electrostatically attracted by a developing member, (for example, a development sleeve and a developing roller) at or before a development region in which the developing member and the latent image carrying member are disposed opposite to each other. By so doing, the residual toner can be collected by the developing unit.

Before being collected by the developing unit, the residual toner passes a position at which an electrostatic latent image is optically formed. When the residual toner on the latent image carrying member is a relatively small amount, an adverse affect may not be exerted for forming the electrostatic latent image. However, when the residual toner contains toner particles that are charged to a polarity opposite to the proper polarity of the toner, the developing member cannot attract such oppositely charged toner particles contained in the residual toner. This may cause a defected image with a background contamination, for example.

To reduce or eliminate the occurrence of background contamination caused by the above-described oppositely charged toner, it is preferable to arrange a toner charging unit for charging the residual toner remaining on the latent image carrying member to the proper polarity of the toner between a transfer position (e.g., primary transfer nip) and a toner spreading position at which the residual toner is spread by the toner spreading member or between the toner spreading position and a development position.

Possible toner spreading members are, for example, a fixed brush with a plurality of conductive fibrous members attached to a metal plate, a unit casing, etc., a brush roller with a plurality of fibrous members arranged in a standing manner on a metallic rotary shaft, a roller including an electrically conductive sponge body, and so forth.

The fixed brush can be formed with a relatively small amount of fibrous members, which may be less expensive. However, when the fixed brush is also used as a charging member for uniformly charging the surface of the latent image carrying member, the fixed brush cannot provide a sufficient uniformity in charging. Compared with the fixed brush, the brush roller is more suitable for a sufficient uniformity in charging.

The catch-and-release type cleaner-less system can use a rotating brush that moves endlessly while contacting the surface thereof with the latent image carrying member. In this case, the rotating brush serves as a catch-and-release member.

The rotating brush temporarily catches the residual toner from the surface of the latent image carrying member. At a given timing, e.g., at a timing after a print job or at a timing between sheet processing operations during the print job, the residual toner caught on the rotating brush is transferred onto the surface of the latent image carrying member again. Then, the developing member electrostatically attracts the residual toner to collect into the developing unit.

A relatively large amount of residual toner remains on the latent image carrying member after a solid image has been formed or a jam has occurred. In such case, the spread type cleaner-less system may cause image deterioration due to the overload to the developing member. On the contrary, the catch-and-release type cleaner-less system can avoid the occurrence of such image deterioration by collecting the residual toner from the rotating brush to the developing member little by little.

The combination type cleaner-less system can use both functions of the spread type system and the catch-and-release type system.

Specifically, a rotary brush member which contacts the latent image carrying member or other similar member is used to perform as a toner spreading member as well as a catch-and-release member. While serving as a toner spreading member when only a DC voltage is applied, the rotary brush member may serve as a catch-and-release member, when necessary, by switching the bias from a DC bias voltage to an AC bias voltage superimposed by a DC bias voltage. Alternatively, the voltage applied to the toner spreading member and the catch-and-release member can be the AC bias voltage.

The process units 1Y, 1M, 1C, and 1K of the printer 100 employ the cleaner-less system of a catch-and-release type. For example, the photoconductor drum 3Y of the process unit 1Y for producing yellow toner image rotates at a linear velocity of approximately 124 mm/sec in a clockwise direction in FIG. 1. At the same time, the photoconductor drum 3Y contacts the outer surface of the intermediate transfer belt 61 to form a primary transfer nip for the transfer of a yellow toner image. The charging unit 8Y applies a charge bias between the plurality of fibrous members 6Y and the photoconductor drum 3Y to uniformly charge the surface of the photoconductor drum 3Y to approximately −500V. At the same time, residual toner remaining on the surface of the photoconductor drum 3Y is transferred to the plurality of fibrous members 6Y by applying a charge bias and physically contacting or scraping with the brush in a synergistic manner so that the residual toner can temporarily be caught by the plurality of fibrous members 6Y.

Then, at the timing after the completion of the print job or at the timing between sheet processing operations during the print job, the charge bias may be switched to a value that may cause the residual toner caught by the plurality of fibrous members 6Y as above to be easily transferred onto the photoconductor drum 3Y. After the above-described switching of the charging bias, the residual toner caught by the plurality of fibrous members 6Y may be transferred to the photoconductor drum 3Y again and be collected into the developing unit 40Y via the developing roller 42Y.

Each of the plurality of fibrous members 6Y of the charging brush roller 4Y is a conductive fiber that is cut to a given length.

Examples of possible materials for the conductive fiber are resin materials, for example, NYLON6®, NYLON12®, acrylic resin, vinylon resin, polyester resin, etc. Conducting particles such as carbon or metallic fine powder are dispersed to the above-described resin material so as to make the fibers conductive.

By taking account of production costs and low Young's modulus, it is preferable to use a conductive fiber made of nylon resin with carbon being dispersed thereto. Carbon may be unevenly distributed in the fiber.

Examples of possible materials for the rotary shaft member 5Y on which the plurality of fibrous members 6Y are mounted in a standing manner are stainless steel, which are SUS303, SUS304, SUS316, SUS416, SUS420, SUS430, and so forth. Free-cutting steel, which are SUM22, SUM23, SUM23L, SUM24L, and so forth, or these materials having a plated surface can also be used.

By taking account of production costs and safeness (excluding lead material), it is preferable to use a member made of SUM22 or SUM23 having a plated surface.

In the process unit 1Y of FIG. 2, a toner charge film 10Y is held in contact with a position on the surface of the photoconductor drum 3Y, which is downstream of the primary transfer nip for the transfer of yellow toner images and upstream of a contact position with the charging brush roller 4Y in a rotation direction of the photoconductor drum 3Y.

The toner charge film 10Y is applied with a toner charge bias by a voltage supplying unit (not shown) to the same polarity as the charge polarity of yellow toner. For example, the toner in an exemplary embodiment of the present invention is applied to a negative polarity.

Residual toner still remaining on the surface of the photoconductor drum 3Y, even after the primary transfer nip for the transfer of yellow toner image, reaches the toner charge film 10Y before being temporarily captured by the charging brush roller 4Y.

A small amount of oppositely charged toner particles in the residual toner may be charged to a regular polarity by action of the toner charge film 10Y.

Alternatively, the toner charge film 10Y may be disposed downstream of the charging brush roller 4Y and upstream of the developing roller 42Y in the rotation direction of the photoconductor drum 3Y, so as to charge the oppositely charged toner particles in the residual toner to a regular polarity while contacting with a position on the surface of the photoconductor drum 3Y.

As described above, the process unit 1Y may be operated to form a yellow toner image.

As previously described, the other process units 1M, 1C, and 1K have basically the same functions and structures as the process unit 1Y, except for different toner colors. Therefore, description of the operations of the other process units 1M, 1C, and 1K are omitted.

As shown in FIG. 1, the transfer unit 60 is arranged below and adjacent to the process units 1Y, 1M, 1C, and 1K.

The transfer unit 60 includes the intermediate transfer belt 61, a driven roller 62, a drive roller 63, a secondary transfer nip roller 64, a tension roller 65, and four primary transfer bias rollers 66Y, 66M, 66C, and 66K.

The intermediate transfer belt 61 is formed of an endless shaped belt member and rotates in a counterclockwise direction in FIG. 1. The intermediate transfer belt 61 is extended by and spanned around the driven roller 62, the drive roller 63, the secondary transfer nip roller 64, the tension roller 65, and the primary transfer bias rollers 66Y, 66M, 66C, and 66K.

The driven roller 62, the drive roller 63, the secondary transfer nip roller 64, the tension roller 65, and the primary transfer bias rollers 66Y, 66M, 66C, and 66K are held in contact with an inner surface of the intermediate transfer belt 61.

The four primary transfer bias rollers 66Y, 66M, 66C, and 66K are rollers, each of which includes a metallic cored bar covered by an elastic material such as sponge. The four primary transfer bias rollers 66Y, 66M, 66C, and 66K are in press contact with the photoconductor drums 3Y, 3M, 3C, and 3K, respectively, while sandwiching the intermediate transfer belt 61 therebetween. At respective positions at which the photoconductor drums 3Y, 3M, 3C, and 3K and the intermediate transfer belt 61 contact at given intervals in a belt moving direction, four primary transfer nips for forming respective single color toner images of different colors may be formed.

A primary transfer bias controlled by respective transfer bias power sources (not shown) to flow a constant current is applied to the cored bars of the primary transfer bias rollers 66Y, 66M, 66C, and 66K. By so doing, a transfer charge can be provided via the primary transfer bias rollers 66Y, 66M, 66C, and 66K to the inner surface of the intermediate transfer belt 61 so that respective electric fields for transfer can be formed at the primary transfer nips formed between the intermediate transfer belt 61 and the photoconductor drums 3Y, 3M, 3C, and 3K.

In the exemplary embodiment of the present invention, the printer 100 includes a roller-shaped member, i.e., the primary transfer bias rollers 66Y, 66M, 66C, and 66K, as a primary transfer member. However, the shape of the primary transfer member is not limited to the above-described roller-shaped member. Alternatively, a brush-type member, blade-type member, or a transfer charger may be applied to the present invention.

The different single color toner images, which are yellow toner image, magenta toner image, cyan toner image, and black toner image, formed on the respective photoconductor drums 3Y, 3M, 3C, and 3K may be transferred onto the intermediate transfer belt 61 at the respective primary transfer nips in an overlaying manner, so that a four color overlaid toner image (hereinafter, referred to as an "overlaid toner image") can be formed on the intermediate transfer belt 61.

At a position at which the secondary transfer nip roller 64 is held in contact with the intermediate transfer belt 61, a secondary transfer bias roller 67 is disposed in a manner contacting the opposite surface or outer surface of the intermediate transfer belt 61. That is, the secondary transfer nip roller 64 and the secondary transfer bias roller 67 are held in contact with each other by sandwiching the intermediate transfer belt 61, thereby forming a secondary transfer nip.

A secondary transfer bias is applied to the secondary transfer bias roller 67 by a voltage applying unit (not shown), which includes a power source and wiring. Thereby, an electric field for the secondary transfer can be formed between the secondary transfer bias roller 67 and the grounded secondary transfer nip roller 64. The overlaid toner image formed on the intermediate transfer belt 61 comes to the secondary transfer nip according to the rotations of the intermediate transfer belt 61.

The printer 100 further includes a sheet feeding cassette (not shown) to accommodate recording media or a plurality of recording papers therein. The sheet feeding cassette feeds a recording paper P placed on top of the recording media accommodated therein to a sheet feeding path at a given timing.

The recording paper P fed from the sheet feeding cassette travels along the sheet feeding path and reaches a pair of registration rollers 54 disposed at a far end of the sheet feeding path, at which the recording paper P is stopped and sandwiched by the pair of registration rollers 54.

The pair of registration rollers 54 rotates to receive the recording paper P from the sheet feeding cassette and sandwich the recording paper P therebetween. Upon sandwiching the leading edge of the recording paper P, the pair of registration rollers 54 stops its rotation. Then, the pair of registration rollers 54 feeds the recording paper P toward the secondary transfer nip in synchronization with a movement of the overlaid toner image formed on the intermediate transfer belt 61.

At the secondary transfer nip, the overlaid toner image on the intermediate transfer belt 61 is secondarily transferred onto the recording paper P by action of the electric field of the secondary transfer and the nip pressure. On the recording paper P, the overlaid toner image is combined with a white color of the recording paper P, resulting in a formation of a full-color image.

The recording paper P with the full-color toner image thereon passes through the secondary transfer nip and comes to a fixing unit (not shown) so as to fix the full-color toner image onto the recording paper P.

After the overlaid toner image has transferred onto the recording paper P, residual toner remaining on the surface of the intermediate transfer belt 61 may be removed by a belt cleaning unit 68.

As described above, with the basic structure of the printer 100 according to an exemplary embodiment of the present invention, the photoconductor drums 3Y, 3M, 3C, and 3K perform as a latent image carrying member for carrying an electrostatic latent image on the surface that endlessly rotates. The optical writing unit 50 performs as a latent image forming unit for forming an electrostatic latent image onto the respective charged surfaces of the photoconductor drums 3Y, 3M, 3C, and 3K serving as latent image carrying members. In addition, the developing units 40Y, 40M, 40C, and 40K develop the electrostatic latent image on the photoconductive drums 3Y, 3M, 3C, and 3K to respective visible color toner images.

Next, processes and results of the tests performed by the inventors of the present invention are described.

The inventors modified RICOH's full color printer, IPSIO CX3000, into a test machine having the same configuration of the printer 100 of FIGS. 1 and 2 according to the first exemplary embodiment of the present invention.

Specifically, the charging roller provided to each process unit in IPSIO CX3000 was replaced to a charging brush roller. The cleaning blades used for removing residual toner on the photoconductive elements in IPSIO CX3000 were removed from the respective photoconductive elements to build a cleaner-less system. It is noted that, while the printer 100 according to the first exemplary embodiment of the present invention employs a two-component developer, IPSIO CX3000 uses a one-component developer. However, it is conceivable that the process and results of the tests described below can be also applicable to the printer 100 according to the first exemplary embodiment of the present invention.

The inventors conducted the tests with the above-described test machine by changing conditions of charge bias. Under the different charge bias conditions, a monochrome 2×2 (two by two) halftone chart (halftone solid image) was copied to obtain a plurality of reproduced halftone images. The inventors evaluated and ranked the reproduced halftone images based on white spots or white deletion that appear in the halftone images and charging uniformity of a photoconductive element for black image. The white spots and charging uniformity were evaluated in a five-grade evaluation system. Ranks 1, 2, and 3 were evaluated as "POOR", and ranks 4 and 5 were evaluated as "GOOD."

Conditions of the charging brush roller are described as follows:

- Material of fibrous member: NYLON6® that includes carbon uniformly dispersed,
- Volume resistivity: $3.6\times10^4$ [Ω·cm],
- Density of fibrous members with respect to a rotating member: 260,000 [per inch$^2$],
- Thickness of fibrous member: 2 [denier],
- Outer diameter of charging brush roller: 11 [mm],
- Inclination rate of oblique or slanted fibrous members F with respect to rotating member: 25% (compared with an outer diameter of charging brush roller with straight fibrous members, which is 13 mm),
- Amount of inroads of fibrous member with respect to photoconductor drum: 0.3 [mm],
- Material of rotating member: SUM23 plated material,
- Outer diameter of rotating member: 5 [mm],
- Rate of circumferential velocity of photoconductor drum and charging brush roller (linear velocity of brush/linear velocity of photoconductor drum): 2.5, and Direction of rotation of charging brush roller: same direction as photoconductor drum (same surface moving direction at a slidable contact portion of a charging brush roller and a photoconductor drum).

Table 1 shows the results of the above-described tests.

TABLE 1

| Test No. | Vpp × 0.4/t | (D/100 − f × t/1000) × 100 | Vpp [V] | t [mm/sec] | f [Hz] | D [%] | White spot noise rank | Charging uniformity rank |
|---|---|---|---|---|---|---|---|---|
| 1 | $2.0 \times 10^3$ | 46 | 1000 | 0.2 | 200 | 50 | Good | Good |
| 2 | $3.3 \times 10^2$ | 36 | 1000 | 1.2 | 120 | 50 | Good | Good |
| 3 | $6.7 \times 10^3$ | 19 | 1000 | 0.06 | 100 | 20 | Good | Good |
| 4 | $7.3 \times 10^3$ | 12 | 1100 | 0.06 | 3000 | 30 | Good | Good |
| 5 | $2.5 \times 10^2$ | 7 | 800 | 1.3 | 120 | 23 | Good | Poor |
| 6 | $8.8 \times 10^3$ | 88 | 1100 | 0.05 | 50 | 88 | Poor | Poor |

In Table 1, the reference letter "D" represents a duty [%] of a wave component that appears in the first half of one cycle of a charging brush roller described above. The reference letter "f" represents a frequency [Hz] of alternating current (AC) voltage. The reference letter "Vpp" represents a peak-to-peak voltage [V] of the AC voltage in the charge bias applied to the charging brush roller for black image. The type of a waveform in the peak-to-peak voltage "Vpp" of the AC voltage can be divided at the center of a range of the peak-to-peak voltage "Vpp" into two types of wave components. One wave component swings to bring the voltage value by a large amount to a regular polarity (negative polarity in the tests) the same as a direct current (DC) component of the charge bias. The other wave component swings to bring the voltage value by a large amount to an opposite or reverse polarity (positive polarity in the tests), opposite to the DC component of the charge bias. Among these two wave components, the reference letter "t" represents a time period [msec] from a swing start point at which the wave component starts to swing by a large amount to the regular polarity that is a polarity that is the same as a DC component of the charge bias to a point at which the amount of the swing of the wave component reaches approximately 80% of an amplitude of the wave component.

Figure 3:
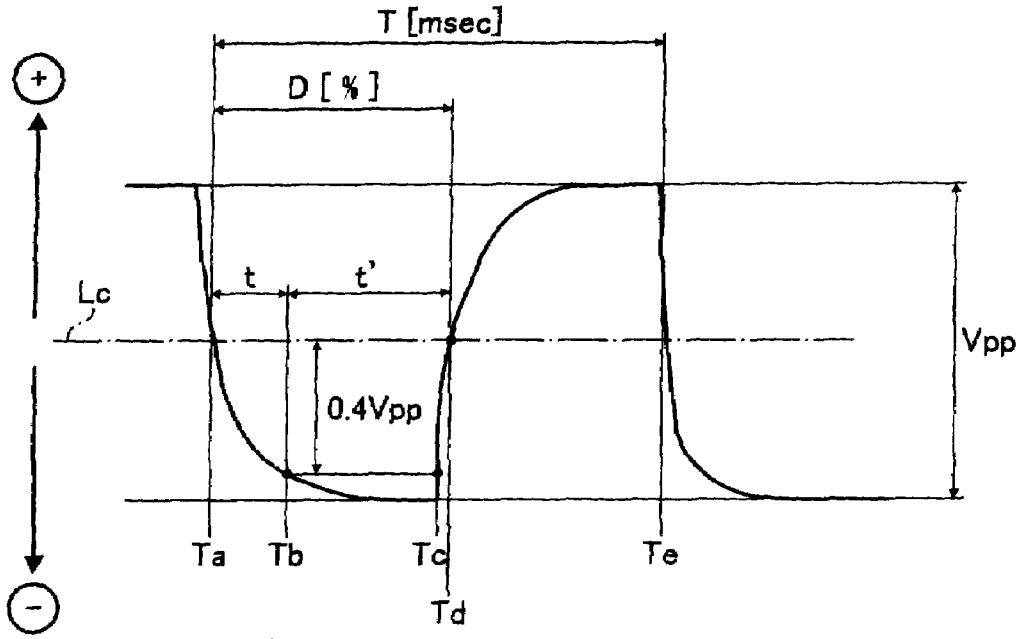
FIG. 3 is a graph showing a waveform of a charge bias applied in the image forming apparatus of FIG. 1.

Referring to FIG. 3, a graph showing waveforms of the charge bias obtained through the above-described tests is described.

As specifically shown in the graph of FIG. 3, one cycle "T" of the AC voltage is in a range from a point "Ta" to a point "Te." When the cycle "T" is divided into two sections at the center line "Lc" of a range of the peak-to-peak voltage, one wave component that swings to a minus (−) side is hereinafter referred to as a "first wave component" and the other wave component that swings to a plus (+) side is hereinafter referred to as a "second wave component". Specifically, the first wave component swings to bring the voltage value by a large amount to a minus (−) side, which is the same polarity as a direct current component of the charge bias appears from the point "Ta" to a point "Td" in the first half of the cycle "T", and the second wave component swings to bring the voltage value by a large amount to a plus (+) side, which is the opposite polarity to the direct current component of the charge bias appears from the point "Td" to the point "Te" in the second half of the cycle "T".

In the above-described first half of the cycle "T", the point "Ta" is the swing start point at which the first wave component starts to swing by a large amount to the minus side. The amount of the swing of the first wave component reaches approximately 80% (0.4×Vpp) of an amplitude (0.5×Vpp) of the first wave component at a point "Tb." A given time period [msec] from the point "Ta" to the point "Tb" is represented by a reference letter "t".

According to the above description, "Vpp×0.4/t" in Table 1 shows a slope indicating the voltage change from the swing start point of the large swing of the first wave component to the minus side (point "Ta") to the point at which the amount of the large swing of the first wave components reaches approximately 80% (0.4×Vpp) of the amplitude (0.5×Vpp) of the first wave component (point "Tb").

For a charge bias including AC wave components as shown in FIG. 3, the second wave component, which appears in the range from the point "Td" to the point "Te" to largely swing to the plus side, can perform a discharging operation for discharging a photoconductive element. At the same time, the first wave component, which appears in the range from the point "Ta" to the point "Td" to largely swing to the minus side, can perform a charging operation for charging the photoconductive element. By repeating the discharging and charging operations, the photoconductive element having potential nonuniformity can be uniformly charged.

As shown in Table 1, white spots exceeding its acceptable level appeared in the halftone image in the result of Test 6 with the slope (Vpp×0.4/t) greater than $7.3 \times 10^3$, which is the value of the slope for Test 4. Therefore, the rank of white spot noise fell on "POOR".

The reasons for the rank of white spot noise in Test 6 may be conceived as follows.

The plurality of fibrous members of the charging brush roller do not have completely identical volume resistivity. Namely, the plurality of fibrous members may have variations in volume resistivity due to nonuniformity in dispersion of the conductive material such as carbon black.

Further, the fibrous members form a bow shape while slidably contacting a body side surface of the leading edge portion or tip portion thereof to the photoconductive element. Even though the leading edge portion itself does not contact to the photoconductive element, there are small gaps between the fibrous members and the photoconductive element.

Electric discharge mostly occurs at the position having such a gap. However, the frequency of occurrence of electric discharge is different according to the distance to the photoconductive element. This is because electric discharge is caused more frequently in a region closer to the photoconductive element, according to Paschen's law.

On the other hand, as previously described, the first wave component that largely swings to the minus side of the AC voltage of the charge bias performs the charging operation with respect to the photoconductive element.

When the slope of the first wave component becomes too large in voltage change or potential change to the minus side, the intensity of the electric field generated between the leading edge portion of the fibrous member and the photoconductive element sharply changes in a significantly short time period. In this case, when the degree of the slope of voltage change or potential change is relatively great at portions having relatively low resistance of the fibrous member and portions having a relatively small gap with respect to the photoconductive element, partially concentrated discharge can easily occur. Such partially concentrated discharge may excessively charge local portions, which can result in a generation of white spots.

Partially concentrated discharge can easily be caused at a tip or leading edge portion of a fibrous member to which a great amount of electric lines of force in an electric field gathers.

When fibrous members are mounted on a brush member in an oblique or slanted manner, the number of fibrous members contacting the leading edge portion with the photoconductive element can be reduced. This can reduce the amount or range of the partially concentrated discharge when compared to the case employing fibrous members mounted on a brush member in a standing manner. However, it is noted that the leading edge portion of the fibrous member cannot be completely hidden.

Accordingly, it is preferable to set the slope (Vpp×0.4/t) in potential change to the minus side of the first wave component to equal to or smaller than $7.3\times10^3$, so that the occurrence of the above-described partially concentrated discharge can be reduced to reduce or prevent the occurrence of white spots.

Figure 4:
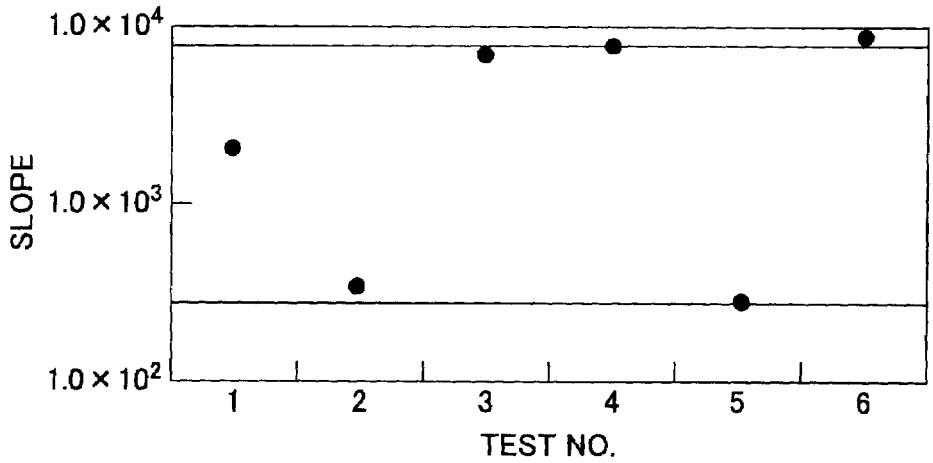
FIG. 4 is a graph in which relations of slope Vpp×0.4/t" under each condition of a charge voltage and the test numbers are mapped.

Referring to FIG. 4, a graph in which the relations between the slopes (Vpp×0.4/t) under each condition of the charge voltage and the test numbers are mapped is described.

According to the relationship of FIG. 4 and Table 1, the appearances of white spots were within an acceptable range when the upper limit value of the slope Vpp×0.4/t) was equal to or smaller than $7.3\times10^3$ in Tests 1, 2, 3, 4, and 5.

In Test 5 with the slope (Vpp×0.4/t) set to $2.5\times10^2$, the rank of the appearance of white spots fell within an acceptable range, whereas the charging to the photoconductive element was not sufficient and the rank was out of its acceptable range.

The reasons of the rank of charging uniformity in Test 5 may be conceived as follows.

A region from the point "Tb" to the point "Tc" in the graph of FIG. 3 is expressed as a time period from the point at which the amount of the swing of the first wave components reaches approximately 80% (0.4×Vpp) of the amplitude of the first wave component swinging to the minus side to the point at which the first wave component fell to smaller than 80% of the amplitude of the first wave component. During this time period, the charging to the photoconductive element may most preferably be performed. However, when the slope (Vpp×0.4/t) is too small, the above-described time period is not sufficiently provided, which can cause charging nonuniformity. Therefore, Test 6 with the smaller slope (Vpp×0.4/t) caused charging nonuniformity.

On the contrary, Test 2 with the second smallest slope ($3.3\times10^2$) had the acceptable result in the rank of charging uniformity. Accordingly, by setting the slope to a value equal to or greater than $3.3\times10^2$, the occurrence of charging nonuniformity to the photoconductive element can be reduced or prevented.

In the graph of FIG. 3, a time "t'" indicates a time period from the point "Tb" at which the amount of the swing of the first wave components reaches approximately 80% (0.4×Vpp) of the amplitude of the first wave component largely swinging to the minus side, to the point "Td" at which the first wave component is switched to the second wave component that largely swings to the plus side.

When the rate of the time "t" with respect to the cycle "T" becomes too great, the rate of the second wave component to the plus side performing the discharging operation within the cycle "T" may become too small, which may cause insufficient discharging. This can cause charging nonuniformity to the photoconductive element.

The rate of the time "t'" with respect to the cycle "T" can be obtained by an expression of "time t'/cycle T×100." The cycle "T" can be obtained by an expression of "1000/frequency f [Hz]". The time "t'" can be obtained by an expression of "1000/frequency f×duty D/100−time t". Accordingly, the expression to obtain the rate of the time "t'" can be modified to an expression of "(duty D/100−frequency f×time t/1000)×100".

As shown in Table 1, Test 5 under the condition of the charge bias in which the solution of the expression becomes "7" and Test 6 under the condition of the charge bias in which the solution of the expression becomes "88" failed to keep the charging uniformity to its acceptable rank.

The reasons of the ranks of charging uniformity in Tests 5 and 6 may be conceived as follows.

When the rate of the time "t'" with respect to the cycle "T" becomes too small, the discharging operation for the photoconductive element can be performed preferably. In this case, however, the time period to effectively charge the photoconductive element, which is the time period from the point "Tb" to the point "Tc" in FIG. 3, may be reduced. Therefore, some portions on the surface of the photoconductive element may be insufficiently charged, which can result in charging nonuniformity.

When the rate of the time "t'" with respect to the cycle "T" becomes too great, the discharging operation may not be sufficiently performed, which can also result in charging nonuniformity.

The inventors then conducted tests for evaluating charging uniformity by changing the rate of the time "t'" with respect to the cycle "T" in further detail.

Specifically, the tests were conducted under conditions with ten different charge biases in which respective solutions of the expression of "(D/100−frequency f×time t/1000)×100" are "8", "9", "10", "11", "12", "78", "79", "80", "81", and "82."

Consequently, the inventors found that the tests conducted under the conditions with the charge biases providing the solutions smaller than "10", which are the tests with the charge biases with the solutions of "8" and "9", resulted in charging nonuniformity exceeding the acceptable range. Therefore, the results of the two tests fell in the rank "POOR".

The inventors also found that the tests conducted under the conditions with the charge biases providing the solutions greater than "80", which are the tests with the charge biases with the solutions of "81" and "82", resulted in charging nonuniformity exceeding the acceptable range. The ranks of the two tests also fell in "POOR".

According to the above-described results, it was found that the charge bias including the AC voltage satisfying a relational expression of "$10<(D/100-f\times t/1000)\times100<80$" can reduce the generation of charging nonuniformity, even when the rate of the time "t'" with respect to the cycle "T" is not appropriate.

Figure 5:
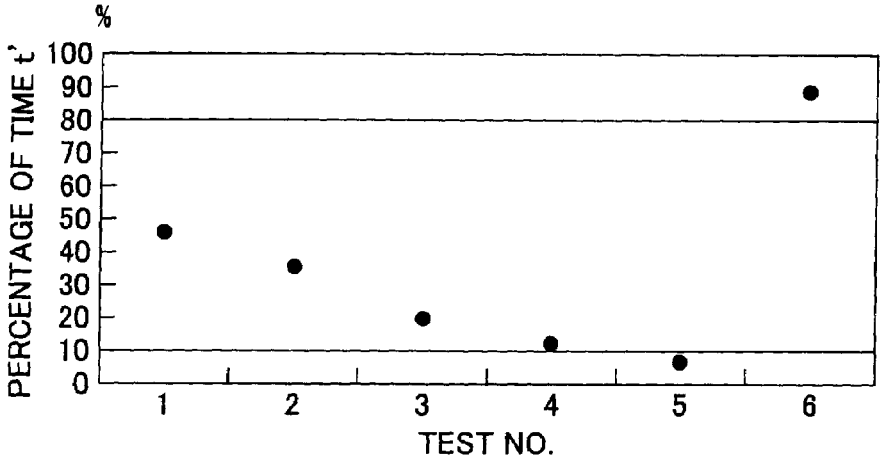
FIG. 5 is a graph in which relations of rate "(duty D/100−frequency f×time t/1000)×100" of a time "t'" with respect to a cycle "T" under each condition of a charge voltage and the test numbers are mapped.

Referring to FIG. 5, a graph in which the relations between the rate ((D/100−frequency f×time t/1000)×100) of the time "t'" with respect to the cycle "T" under each condition of the charge voltage and the test numbers are mapped is described.

According to the relationship of FIG. 5 and Table 1, when the rate ((D/100−frequency f×time t/1000)×100) is set between the lower and upper limit values as "10<the solution of the rate<80" in Tests 1, 2, 3, and 4, the generation of charging nonuniformity can be within an acceptable range.

Next, the inventors conducted tests by changing the conditions of the charge bias, and reached the following respective conclusions based on the results obtained from the tests.

(1) When the peak-to-peak voltage "Vpp" of the AC voltage is set to a value smaller than 200V, the charging ability is degraded to cause a defect in charging.

(2) When the peak-to-peak voltage "Vpp" of the AC voltage is set to a value greater than 1200V, the discharge of electricity on the photoconductive element on which an amount of electric charge is applied is excessive, and may cause charging nonuniformity. Accordingly, it is preferable to set the peak-to-peak voltage "Vpp" in a range from approximately 200V to approximately 1200V, and more preferable to set the peak-to-peak voltage "Vpp" in a range from approximately 700V to approximately 1100V.

(3) It is preferable to set the time "t" in a range from approximately 0.05 msec to approximately 1.5 msec. When the value of the time "t" is set outside the range, charging nonuniformity may be caused.

(4) When the frequency "f" is set to a value smaller than 10 Hz, periodical density nonuniformity may be caused on an image according to the frequency "f".

(5) When the frequency "f" is set to a value greater than 3000 Hz, noise due to vibration of fibrous members may be caused according to the change of intensity of the electric field.

(6) When the duty "D" of the first wave component that largely swings to the minus side is set outside a range from approximately 25% to approximately 85%, charging nonuniformity may be generated.

Next, the inventors conducted tests for evaluating the ranks of white spots and charging uniformity by changing the conditions of the charge brush, and reached the following respective conclusions based on the results obtained from the tests.

(7) When the volume resistivity of fibrous member is set to a value smaller than $1.0\times10^3$ Ω·cm, an excessive electric discharge may be caused. In the tests, the excessive electric discharge caused the noise of white spots even though the appropriate charge biases were set.

(8) When the volume resistivity of the fibrous member is set to a value greater than $1.0\times10^7$ Ω·cm, an insufficient electric discharge may be caused, which cannot charge the photoconductive element sufficiently. Accordingly, it is preferable to set the volume resistivity of the fibrous member in a range from approximately $1.0\times10^3$ Ω·cm to approximately $1.0\times10^7$ Ω·cm, and more preferable to set the volume resistivity of the fibrous member in a range from approximately $3.0\times10^3$ Ω·cm to approximately $4.0\times10^6$ Ω·cm.

(9) When the density of fibrous members with respect to the rotary shaft member is set to a value smaller than 120,000 per inch$^2$, a defect in charging may be caused.

(10) When the density of fibrous members with respect to the rotary shaft member is set to a value greater than 500,000 per inch$^2$, a greater damage may be caused to the photoconductive element because of poorer flexibility of the charge brush. Accordingly, it is preferable to set the density of fibrous members with respect to the rotary shaft member in a range from approximately 120,000 per inch$^2$ to approximately 500,000 per inch$^2$, and more preferable to set the density of fibrous members with respect to the rotary shaft member in a range from approximately 150,000 per inch$^2$ to approximately 400,000 per inch$^2$.

(11) When the thickness of the fibrous member is set to a value smaller than 0.7 denier, the intensity of electric fields around the leading edge of the fibrous member increases to an excessive amount. In the tests, the excessive intensity caused an excessive electric discharge, and generated white spots even though the appropriate charge biases were set.

(12) When the thickness of the fibrous member is set to a value greater than 5.0 denier, charging nonuniformity may be caused. In the tests, the charging nonuniformity was caused due to an excessive increase of space between the fibrous members. Accordingly, it is preferable to set the thickness of the fibrous member in a range from approximately 0.7 denier to approximately 5.0 denier, and more preferable to set the thickness of the fibrous member in a range from approximately 1.0 denier to approximately 3.0 denier.

(13) When the outer diameter of the charging brush roller is set to a value smaller than 10 mm, a desired hardness cannot be obtained. Specifically, by setting the outer diameter of the charging brush roller to a smaller value, the outer diameter of the rotary shaft member became smaller as well. Therefore, a sufficient hardness of the rotary shaft member was not obtained.

(14) When the outer diameter of the charging brush roller is set to a value greater than 16 mm, the size of the charging unit cannot be reduced. Accordingly, it is preferable to set the outer diameter of the charging brush roller in a range from approximately 10 mm to approximately 16 mm, and more preferable to set the outer diameter of the charging brush roller in a range from approximately 10.5 mm to approximately 14 mm.

(15) When the inclination rate of slanted fiber "F" is set to 10%, white spots may be generated. In the tests, white spots appeared even though the appropriate charge biases were set.

(16) When the inclination rate of slanted fiber "F" is set to a value greater than 40%, the contact surface product of the photoconductive element and the fibrous members may excessively increase, which can cause nonuniformity in toner removal by the charging brush member. Accordingly, it is preferable to set the inclination rate of slanted fiber "F" in a range from approximately 10% to approximately 40%, and more preferable to set the inclination rate of slanted fiber "F" in a range from approximately 20% to approximately 30%.

(17) When the plurality of fibrous members contact the photoconductive element, each fibrous member is pressed by a given contact pressure to the photoconductive element. That is, the plurality of fibrous members press the photoconductive element with some amount of inroads. The amount of inroads can be obtained by subtracting a value of the length of a fibrous member contacting the photoconductive element in a direction of a normal line of the rotary shaft member from a value of the length of a fibrous member not contacting the photoconductive element in the direction of a normal line of the rotary shaft member. When the above-described amount of inroads is set to a value smaller than 0.1 mm, an excessive electric discharge may be caused at the leading edge of the fibrous member. In the tests, white spots appeared even though the appropriate charge biases were set.

(18) When the amount of inroads of the fibrous member with respect to the photoconductive element is set to a value greater than 1.4 mm, nonuniformity in toner removal by the charging brush member may occur. In the tests, nonuniformity in toner removal actually occurred. In addition, the contact surface product of the photoconductive element and the fibrous members may excessively increase, which can cause the partially excessive discharge. This caused white spots to appear even though the appropriate charge biases were set. Accordingly, it is preferable to set the amount of inroads in a range from approximately 0.1 mm to approximately 1.4 mm, and more preferable to set the amount of inroads in a range from approximately 0.15 mm to approximately 0.8 mm.

Figure 6:
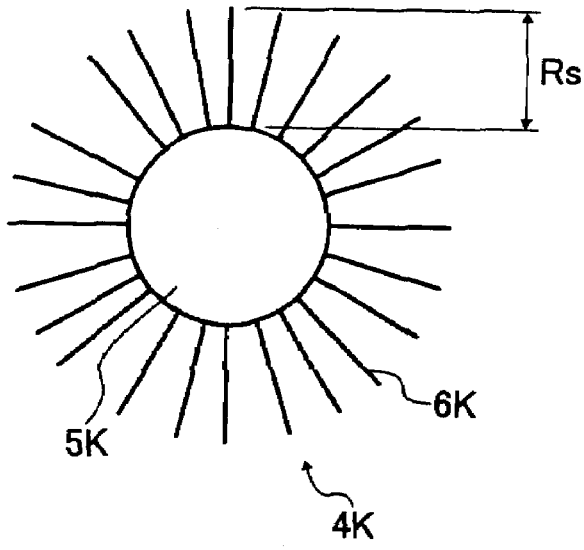
FIG. 6 is a schematic structure of a plurality of fibrous members mounted on a rotary shaft member for a black color in a standing manner.
Figure 7:
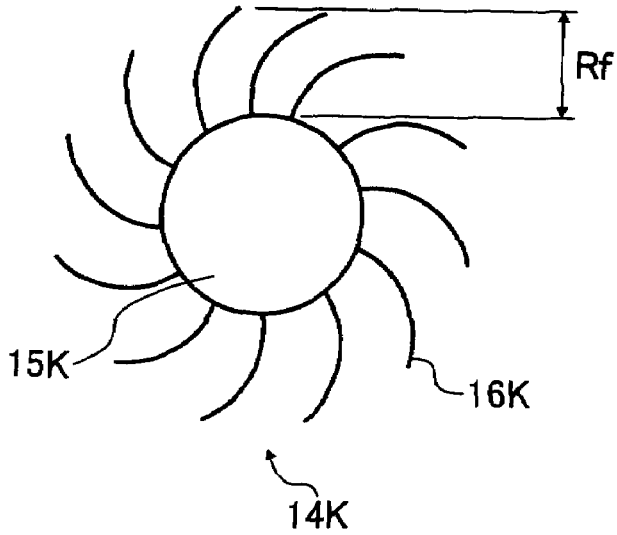
FIG. 7 is a schematic structure of a plurality of fibrous members mounted on a rotary shaft member in a slanted manner.

Here, the inclination rate of slanted fiber "F" is described in reference to FIGS. 6 and 7.

FIG. 6 shows a schematic structure of the charging brush roller 4K for a black image. The charging brush roller 4K of FIG. 6 includes the plurality of fibrous members 6K mounted on the rotary shaft member 5K in a straight standing manner.

In the structure of the charging brush roller 4K of FIG. 6, the plurality of fibrous members 6K extend in a normal line direction with respect to the rotary shaft member 5K.

FIG. 7 shows a schematic structure of a charging brush roller 14K for a black image. The charging brush roller 14K of FIG. 7 includes a plurality of fibrous members 16K mounted on a rotary shaft member 15K in an oblique or slanted manner.

In the structure of the charging brush roller 14K of FIG. 7, the plurality of fibrous members 16K do not extend in a normal line direction with respect to the rotary shaft member 15K. That is, the plurality of fibrous members 16K obliquely extend with respect to the rotary shaft member 15K.

When compared with the plurality of fibrous members 6K mounted in a straight standing manner, the plurality of fibrous members 16K mounted in an oblique or slanted manner may flexibly contact and separate from the photoconductive element. This can reduce abnormal electric discharge from the leading edge of the fibrous members 16K. Accordingly, the plurality of the fibrous members 16K mounted in an oblique or slanted manner can reduce the portions that are excessively discharged, and the amount of the noise of white spots can be reduced.

The degree of inclination of the plurality of fibrous members 16K can be expressed by the inclination rate of fibrous member "F".

The inclination rate of fibrous member "F" can be obtained by Equation 1 as shown below:

$$F=(Rs-Rf)/Rs\times 100 \qquad \text{Equation 1,}$$

where "Rs" represents a length of fibrous member 6K of FIG. 6, and "Rf" represents a distance of fibrous member 16K from the surface of the rotary shaft member 15K to the leading edge of the fibrous member 16K in a normal line direction of the rotary shaft member 15K.

According to the results of the above-described tests, the inventors determined the following conditions of the process units 1Y, 1M, 1C, and 1K of the printer 100 according to the first exemplary embodiment of the present invention:

(a) $3.3\times10^2 \leqq Vpp\times0.4/time\ t \leqq 7.3\times10^3$, (b) $10<(duty\ D/100-frequency\ f\times time\ t/1000)\times100<80$, (c) Peak-to-peak voltage Vpp=200V to 1200V, (d) Time t=0.05 msec to 1.5 msec, (e) Frequency f=10 Hz to 3000 Hz, (f) Duty D=25% to 85%, (g) Volume resistivity of fibrous member=$1.0\times10^3$ Ω·cm to $1.0\times10^7$ Ω·cm, (h) Density of fibrous members=120,000 per inch$^2$ to 500,000 per inch$^2$, (i) Thickness of fibrous member=0.7 denier to 5 denier, (j) Diameter of charging brush roller=10 mm to 16 mm, (k) Inclination rate of slanted fibers F=10% to 40%, and (l) Amount of inroads of fibrous member with respect to photoconductive element=0.1 mm to 1.4 mm.

The linear velocity of the charging brush roller is preferably set to a range in which the ratio to the linear velocity of the photoconductive element is greater than 1 and smaller than 6.

When the ratio of the linear velocity of the charging brush roller to the linear velocity of the photoconductive element is equal to or smaller than 1, the photoconductive element may not be sufficiently charged.

When the ratio of the linear velocity of the charging brush roller to the linear velocity of the photoconductive element is equal to or greater than 6, the sizes of gears and motor for driving the charging brush roller may increase, which can cause an increase of manufacturing costs.

Accordingly, it is preferable to set the ratio of the linear velocity of the charging brush roller to the linear velocity of the photoconductive element in a range of 1<the ratio<6, and more preferable to set the ratio of the linear velocity of the charging brush roller to the linear velocity of the photoconductive element in a range of 1.5<the ratio<4.

The rotation or surface traveling direction of the charging brush roller is preferably set to the same direction as the photoconductive element so as to move the surface of the charging brush roller and the surface of the photoconductive element to travel in the same direction. With the above-described surface traveling direction, the charging brush roller can effectively release the residual toner temporarily caught thereby to the photoconductive element. When compared with a charging brush roller with the surface traveling direction opposite to the photoconductive element, the charging brush roller with the surface traveling in the same direction as the photoconductive element may have a smaller relative speed difference. However, by increasing the number of rotations of the charging brush roller with the surface traveling in the same direction as the photoconductive element, the photoconductive element can be uniformly charged.

Figure 8:
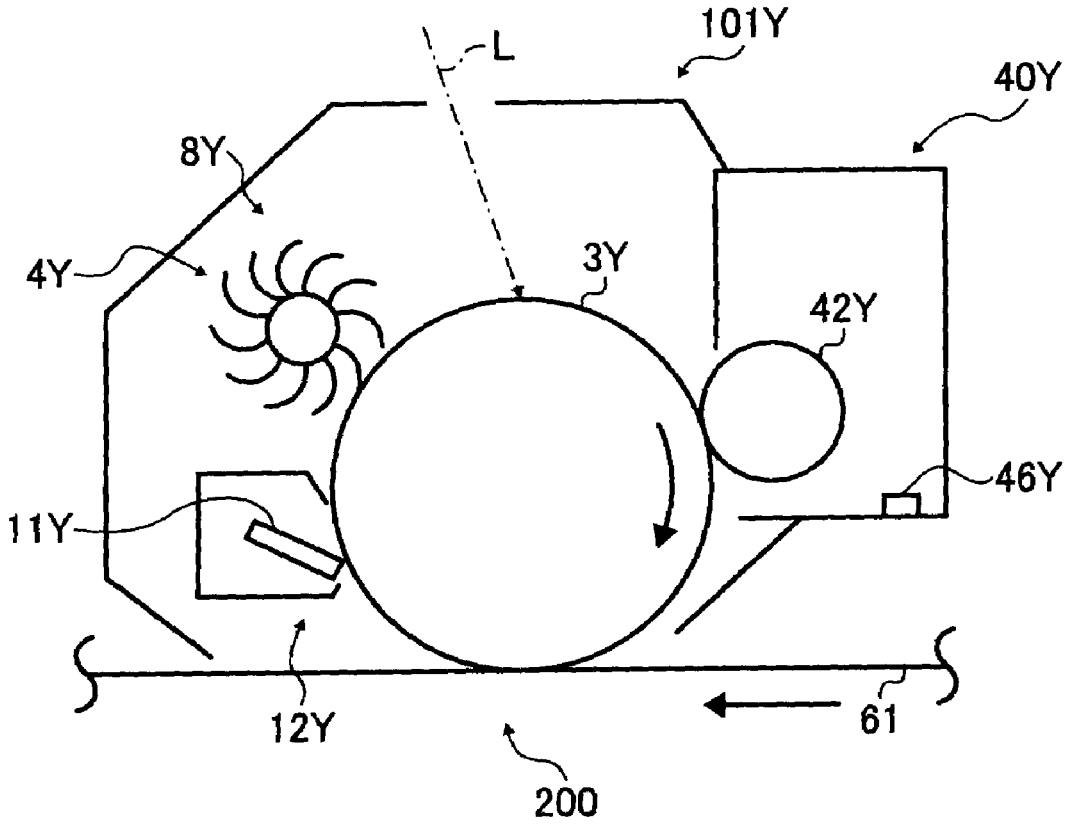
FIG. 8 is a schematic structure of a modified process unit according to an exemplary embodiment of the present invention.

Next, referring to FIG. 8, a schematic structure of a modified process unit 101Y according to a second exemplary embodiment of the present invention is described.

The process unit 101Y is a modified model of the process unit 1Y, and is used in a printer 200.

The units and devices in the printer 200 having the same structures and functions as the printer 100 employ the reference numbers same as those in the printer 100.

The structure and functions of the printer 200 are basically same as those of the printer 100. Except, the process unit 101Y of the printer 200 employs a system using a cleaner for removing residual toner on the photoconductor drum 3Y.

The process unit 101Y of FIG. 8 includes a drum cleaning unit 12Y and a cleaning blade 11Y.

After the transfer of a toner image onto the intermediate transfer belt 61, the drum cleaning unit 12Y uses the cleaning blade 11Y to scrape the residual toner from the surface of the photoconductor drum 3Y. The scraped residual toner is then conveyed to a toner collection bottle (not shown) or the developing unit 40Y of FIG. 8.

Next, processes and results of the tests performed by the inventors of the present invention are described.

The inventors used the test machine modified based on RICOH's IPSIO CX3000, in which the charging member was replaced from the charging brush roller to a charging roller to form the similar structure as shown in the process unit 101Y. Specifically, the charging brush roller used in the previously described test machine based on RICOH's IPSIO CX3000 was replaced to a charging roller.

The charging roller includes a cored bar made of stainless steel, and an elastic layer and a surface layer sequentially laminated over the circumferential surface of the cored bar.

The elastic layer includes an epichlorohydrin rubber, and the surface layer is processed with process solution including isocyanate compound. (The inventors referred to Japanese Patent Application Publication 2001-348443 for forming the above-described charging roller.)

The volume resistivity of the surface of the charging roller is $1\times10^7$ Ω·cm. The JIS-A hardness of the surface of the charging roller is 57 degrees. The surface roughness "Rz" of the charging roller complying with a standard of JIS B 0601 1994 is 12 μm. The outer diameter of the charging roller is 9.5 mm.

The volume resistivity of the surface of the charging roller provided to the test machine was measured as follows.

First, the charging roller was set to a conductive base plate that is grounded. At both ends of the cored bar of the charging roller, a load having "F=4.9N (=500 gf)" is applied. That is, the charging roller is applied with "F=9.8N (=1 kgf)" in total. Thus, a nip is formed between the base plate and the charging roller.

Next, a direct current power source is connected to the cored bar of the charging roller via an ampere meter to apply a direct current (DC) voltage (=1V). After the current I [A] obtained at the application of the DC current voltage was read, the applied voltage "V" [V] and the measured value of the current "I" [A] were substituted to a relational expression of "ρv=(V/I)×(L1×W)/L2" to obtain the volume resistivity "ρv". In the relational expression, the reference letter "L1" represents a length [cm] of the roller part in an axis direction of the charging roller, the reference letter "L2" represents a distance [cm] obtained by subtracting a radius of the roller shaft from a radius of the roller part of the charging roller, and the reference letter "W" represents a distance or nip width [cm] in the lateral direction of the nip.

With the test machine having the above-described structure, the inventors conducted the tests by changing conditions of charge biases. Under the different charge bias conditions, a monochrome 2×2 (two by two) halftone chart (halftone solid image) was copied to obtain a plurality of reproduced halftone images. The inventors evaluated and ranked the reproduced halftone images based on white spots or white deletion that appear in the halftone images and charging uniformity of a photoconductive element for a black image. The white spots and charging uniformity were evaluated in a five-grade evaluation system. Rank 5 was evaluated as "GOOD", rank 4 was evaluated as "ACCEPTABLE", and ranks 1, 2, and 3 were evaluated as "POOR". Ranks 4 and 5 indicate that the result was in an allowable range of the tests. The ratio of the linear velocity of the charging roller to the linear velocity of the photoconductive element was set to 2.5. The surface traveling direction of the charging roller was set to the same direction as that of the photoconductive element.

Table 2 shows the results of the above-described tests.

As shown in Table 2, white spots exceeding the acceptable level appeared in the halftone image in the result of Test 13 with the slope (Vpp×0.4/t) greater than $8.8\times10^3$, which is the value of the slope for Test 11. Therefore, the rank of white spot noise fell on "POOR". However, when the slope (Vpp×0.4/t) is set to $8.8\times10^3$ (in Test 11), the noise of white spots lies within the acceptable level. Accordingly, when the charging roller is used as a charging member, the upper limit of the slope is $8.8\times10^3$. The upper limit of the slope with the charging roller is greater than the upper limit of the slope with the charging brush roller, which is $7.3\times10^3$.

The reasons for the above-described difference between the use of the charging roller and the charging brush roller may be conceived as follows.

When the charging brush roller is used, the partially concentrated electric discharge may be caused from the leading edge of fibrous members, as previously described. On the contrary, when the charging roller is used, the partially concentrated electric discharge may be caused not from the leading edge of fibrous members but from the circumferential surface of the charging roller. Therefore, the partially concentrated electric discharge may not be easily caused to excessively charge local portions of the surface of the photoconductive element.

Other than the charging roller, a sheet-shaped charging member, e.g., PET (polyethylene terephthalate) sheet, and a plate-shaped charging blade made of resin material may cause electric discharge from the surface of the charging member. Accordingly, when the sheet-shaped charging member or the plate-shaped charging blade is used, the upper limit of the slope may be $8.8\times10^3$.

In Test 12 with the slope (Vpp×0.4/t) set to $2.5\times10^2$, the rank of the appearance of white spots fell within an acceptable range, whereas the charging to the photoconductive element was not sufficient. It is conceivable that the insufficient charging was caused due to the same reason as the case with the charging brush roller. When the charging roller is used, the charging failure, such as the insufficient charging, can be prevented by setting the slope equal to or greater than $3.3\times10^2$ as conducted in Tests 7 through 11.

Next, the inventors conducted tests for evaluating charging uniformity by changing the rate of the time "t" with respect to the cycle "T" in further details, as previously conducted in the first exemplary embodiment of the present invention. Specifically, the tests were conducted under conditions with ten different charge biases in which respective solutions of the expression of "(D/100−frequency f×time t/1000)×100" were "8", "9", "10", "11", "12", "78", "79", "80", "81", and "82."

Consequently, as in the case when the charging brush roller was used, the inventors found that the tests conducted under

TABLE 2

| Test No. | Vpp × 0.4/t | (D/100 − f × t/1000) × 100 | Vpp [V] | t [mm/sec] | f [Hz] | D [%] | White spot noise rank | Charging uniformity rank |
|---|---|---|---|---|---|---|---|---|
| 7 | $2.0\times10^3$ | 46 | 1000 | 0.2 | 200 | 50 | GOOD | GOOD |
| 8 | $3.3\times10^2$ | 36 | 1000 | 1.2 | 120 | 50 | GOOD | GOOD |
| 9 | $6.7\times10^3$ | 19 | 1000 | 0.06 | 100 | 20 | GOOD | GOOD |
| 10 | $7.3\times10^3$ | 12 | 1100 | 0.06 | 3000 | 30 | GOOD | GOOD |
| 11 | $8.8\times10^3$ | 49 | 1100 | 0.05 | 300 | 50 | ACCEPTABLE | GOOD |
| 12 | $2.5\times10^2$ | 7 | 800 | 1.3 | 120 | 23 | GOOD | POOR |
| 13 | $9.6\times10^3$ | 85 | 1200 | 0.05 | 300 | 86 | POOR | POOR |

the conditions with the charge biases providing the solutions smaller than "10" resulted in charging nonuniformity exceeding the acceptable range.

The inventors also found that the tests conducted under the conditions with the charge biases providing the solutions greater than "80", which are the tests with the charge biases with the solutions of "81" and "82", resulted in charging nonuniformity exceeding the acceptable range.

According to the above-described results, it was found that the charge bias including the AC voltage satisfying a relational expression of "$10<(D/100-f\times t/1000)\times 100<80$" can reduce the generation of charging nonuniformity, even when the rate of the time "t" with respect to the cycle "T" is not appropriate.

Next, the inventors conducted tests by changing the conditions of the charge biases, and reached the following respective conclusions based on the results obtained from the tests, as previously conducted in the first exemplary embodiment of the present invention.

When the peak-to-peak voltage "Vpp" of the AC voltage is set to a value smaller than 200V, the charging ability is degraded which causes a defect in charging.

When the peak-to-peak voltage "Vpp" of the AC voltage is set to a value greater than 1200V, the discharge of electricity on the photoconductive element on which an amount of electric charge is applied is excessive, and may cause charging nonuniformity.

When the value of the time "t" is set outside the range from approximately 0.05 msec to approximately 1.5 msec, charging nonuniformity may be caused.

When the frequency "f" is set to a value smaller than 10 Hz, periodical charging nonuniformity may be caused on an image according to the frequency "f".

When the frequency "f" is set to a value greater than 3000 Hz, noise due to vibration of fibrous members may be caused according to the change of intensity of the electric field.

When the duty "D" of the first wave component that largely swings to the minus side is set outside the range from approximately 25% to approximately 85%, charging nonuniformity may be generated.

Accordingly, these results were the same as the results obtained from the tests conducted by using the charging brush roller.

Next, the inventors conducted tests for evaluating the ranks of white spots and charging uniformity by changing the conditions of the charge brush, and reached the following respective conclusions based on the results obtained from the tests.

(19) When the volume resistivity on the surface of the roller part of the charging roller is smaller than $1\times10^4$, white spots appear due to excessive charging even when the appropriate charge biases are set.

(20) When the volume resistivity on the surface of the roller part of the charging roller is greater than $1\times10^9$ Ω·cm, an insufficient electric discharge may be caused, which cannot charge the photoconductive element sufficiently. Accordingly, it is preferable to set the volume resistivity on the surface of the roller part of the charging roller in a range from approximately $1\times10^4$ Ω·cm to approximately $1\times10^9$ Ω·cm, and more preferable to set the volume resistivity on the surface of the roller part of the charging roller in a range from approximately $8\times10^4$ Ω·cm to approximately $7\times10^8$ Ω·cm.

(21) When the JIS-A hardness of the surface of the roller part of the charging roller starts to drop below 30 degrees, the condition of the surface of the roller part of the charging roller rapidly turns to become easily contaminated. This may cause a sharp deterioration in the charging ability.

(22) When the JIS-A hardness of the surface of the roller part of the charging roller starts to rise above 70 degrees, the roller part of the charging roller rapidly fails to contact with the photoconductive element. This may also cause a sharp deterioration in the charging ability. Accordingly, it is preferable to set the JIS-A hardness of the surface of the roller part of the charging roller in a range from approximately 30 degrees to approximately 70 degrees, and more preferable to set the JIS-A hardness of the surface of the roller part of the charging roller in a range from approximately 40 degrees to approximately 60 degrees.

(23) To make the surface roughness "Rz" of the roller part of the charging roller smaller than 1 μm, a high skill and/or technique may be needed. Consequently, this can cause a sharp increase in the manufacturing cost.

(24) When the surface roughness "Rz" of the roller part of the charging roller starts to rise above 40 μm, the condition of the surface of the roller part of the charging roller rapidly turns to become easily contaminated. This may cause a sharp deterioration in the charging ability. Accordingly, it is preferable to set the surface roughness "Rz" of the roller part of the charging roller in a range from approximately 1 μm to approximately 40 μm, and more preferable to set the surface roughness "Rz" of the roller part of the charging roller in a range from approximately 3 μm to approximately 30 μm.

(25) When the outer diameter of the roller part of the charging roller starts to drop below 7 mm, the charging roller increases the degree of its bow or deflection in a longitudinal direction or axial direction. This may rapidly cause a sharp defect in charging uniformity.

(26) When the outer diameter of the roller part of the charging roller starts to rise above 16 mm, a depression effect by the bow or deflection of the roller part of the charging roller exerted by the increase of the outer diameter rapidly falls. Accordingly, it is preferable to set the outer diameter of the roller part of the charging roller in a range from approximately 7 mm to approximately 16 mm, and more preferable to set the outer diameter of the roller part of the charging roller in a range from approximately 8 mm to approximately 13 mm.

According to the results of the above-described tests, the inventors determined the following conditions of the process units 1Y, 1M, 1C, and 1K of the printer 100 according to the second exemplary embodiment of the present invention:

(a) $3.3\times10^2 \leqq Vpp\times0.4/\text{time } t \leqq 8.8\times10^3$, (b) $10<(\text{duty } D/100-\text{frequency } f\times\text{time } t/1000)\times100<80$, (c) Peak-to-peak voltage Vpp=200V to 1200V, (d) Time t=0.05 msec to 1.5 msec, (e) Frequency f=10 Hz to 3000 Hz, (f) Duty D=25% to 85%, (g) Volume resistivity of the charging roller on the surface of a roller part thereof=$1.0\times10^4$ Ω·cm to $1.0\times10^9$ Ω·cm, (h) JIS-A hardness of the charging roller on the surface of a roller part thereof=30 degrees to 70 degrees, (i) Surface roughness Rz on the surface of a roller part of the charging roller=1 μm to 40 μm, and (j) Outer diameter of a roller part of the charging roller=7 mm to 16 mm.

As an alternative to the charging roller, a charge sheet, a charge blade, or other similar charging member can be applied. In such case, the above-described conditions can be applicable to each charging member.

The above-described operations and conditions are described for a tandem-type printer in which respective single color toner images of different colors formed on a plurality of process units are sequentially overlaid to form a full-color toner image.

However, the operations and conditions of the present invention can be applied an image forming apparatus employing a single-type system as well. The single-type image forming apparatus includes one latent image carrying member, such as a photoconductive element, and a plurality of developing units for different colors arranged around the latent image carrying member. While sequentially switching the plurality of developing units, respective single color toner images are sequentially transferred onto an intermediate transfer member to form a full-color image.

Further, the operations and conditions of the present invention can be applied to an image forming apparatus forming a monochrome image only.

As described above, the printer 100 according to the first exemplary embodiment of the present invention includes a charge bias applying unit for applying, to a charging brush roller, an AC voltage bias satisfying a rational expression of "$3.3\times10^2 \leqq Vpp\times0.4/t$". With the above-described structure, an insufficient charging to a photoconductive element caused by a small slope of "$Vpp\times0.4/t$" can be reduced or prevented if possible.

In addition, the printer 100 according to the first exemplary embodiment of the present invention uses a charging brush roller as a charging member. When compared with a charging roller, the charging brush roller can reduce or prevent, if possible, the occurrence of filming on the surface of the photoconductive element. Filming is a phenomenon that contamination, e.g., toner contamination, on the surface of a target member, e.g., photoconductive element of an image forming apparatus, is adhered and fixed thereto in a film-like manner.

The printer 100 according to the first exemplary embodiment of the present invention and the printer 200 according to the second exemplary embodiment of the present invention use a charge bias applying unit for applying, to a charging member, e.g., charging brush roller or charging roller, an AC current voltage having a relational expression satisfying "$10<(\text{duty } D/100-\text{frequency } f\times\text{time } t/1000)\times100<80$." With the above-described structure, the occurrence of a charging nonuniformity caused by an inappropriate rate of the timer "t" with respect to the cycle "T" can be reduced or prevented if possible.

In the printer 100 according to the first exemplary embodiment of the present invention and the printer 200 according to the second exemplary embodiment of the present invention, the peak-to-peak voltage "Vpp" is set to a value in the range from approximately 200V to approximately 1200V. Accordingly, as previously described, the above-described setting of the peak-to-peak voltage "Vpp" can reduce or prevent, if possible, the defect in charging the photoconductive element caused by a rather small amount of the peak-to-peak voltage and the charging nonuniformity of the photoconductive element caused by a rather great amount of the peak-to-peak voltage.

In the printer 100 according to the first exemplary embodiment of the present invention and the printer 200 according to the second exemplary embodiment of the present invention, the time "t" is set in the range from approximately 0.05 msec to approximately 1.5 msec. Accordingly, as previously described, the above-described setting of the time "t" can reduce or prevent, if possible, the occurrence of the charging nonuniformity of the photoconductive element caused by an inappropriate period of the time "t".

In the printer 100 according to the first exemplary embodiment of the present invention and the printer 200 according to the second exemplary embodiment of the present invention, the frequency "f" of the AC voltage bias is set in the range from approximately 10 Hz to approximately 3000 Hz. Accordingly, as previously described, the above-described setting of the frequency "f" can reduce or prevent, if possible, the periodical density nonuniformity caused by a rather small frequency "f" and the occurrence of the noise caused by a rather great frequency "f".

In the printer 100 according to the first exemplary embodiment of the present invention and the printer 200 according to the second exemplary embodiment of the present invention, the duty "D" of the first wave component that largely swings to the same polarity as the AC voltage bias side is set in the range from approximately 25% to approximately 85%. Accordingly, as previously described, the above-setting of the duty "D" can reduce or prevent, if possible, the occurrence of the charging nonuniformity of the photoconductive element caused by an inappropriate percentage of the duty "D".

In the printer 100 according to the first exemplary embodiment of the present invention, the volume resistivity of the fibrous member is set in the range from approximately $1.0\times10^3$ Ω·cm to approximately $1.0\times10^7$ Ω·cm. Accordingly, as previously described, the above-described setting of the volume resistivity of the fibrous member can reduce or prevent, if possible, the occurrence of the noise of white spots caused by a rather small volume resistivity of the fibrous member and the occurrence of the defect in charging the photoconductive element caused by a rather great volume resistivity of the fibrous member.

In the printer 100 according to the first exemplary embodiment of the present invention, the density of fibrous members with respect to the rotary shaft member is set in the range from approximately 120,000 per inch$^2$ to approximately 500,000 per inch$^2$. Accordingly, as previously described, the above-described setting of the density of fibrous members can reduce or prevent, if possible, the occurrence of the defect in charging the photoconductive element caused by a rather small density of fibrous members and the deterioration from abrasion of the photoconductive element caused by a rather great density of fibrous members.

In the printer 100 according to the first exemplary embodiment of the present invention, the thickness of the fibrous member is set in the range from approximately 0.7 denier to approximately 5.0 denier. Accordingly, as previously described, the above-described setting of the thickness of fibrous members can reduce or prevent, if possible, the occurrence of the noise of white spots caused by a rather small thickness of the fibrous member and the occurrence of the charging nonuniformity of the photoconductive element caused by a rather great thickness of the fibrous member.

The printer 100 according to the first exemplary embodiment of the present invention includes the charging brush roller including a rotary shaft member on the surface of which the plurality of fibrous members are mounted in a standing manner. Accordingly, the charging brush roller rotates to effectively scrape residual toner so that the charging brush roller can temporarily catch the residual toner.

In the printer 100 according to the first exemplary embodiment of the present invention, the outer diameter of the charging brush roller is set in the range from approximately 10 mm to approximately 16 mm. Accordingly, as previously described, the above-described setting of the outer diameter can reduce or prevent, if possible, the insufficient hardness of the charging brush roller caused by a rather small outer diameter of the charging brush roller and the increase of size of the charging unit caused by a rather great outer diameter.

In the printer 100 according to the first exemplary embodiment of the present invention, the inclination rate of oblique or slanted fibrous member "F" is set in a range from approximately 10% to approximately 40%. Accordingly, as previously described, the above-described setting of the inclination rate of slanted fibrous member "F" can reduce or prevent, if possible, the occurrence of the noise of white spots caused by a rather small inclination rate of slanted fibrous member "F" and the occurrence of nonuniformity in toner removal caused by a rather great inclination of slanted fibrous member "F".

In the printer 100 according to the first exemplary embodiment of the present invention, the amount of inroads of the fibrous member with respect to the photoconductive element is set in a range from approximately 0.1 mm to approximately 1.4 mm. Accordingly, as previously described, the above-described setting of the amount of inroads can reduce or prevent, if possible, the occurrence of white spots caused by an unstable amount of inroads of fibrous members.

The printer 200 according to the second exemplary embodiment of the present invention includes a charging roller as a charging member. When compared with the charge bias roller, a greater amount of the upper limit of the above-described slope can be set.

The printer 200 according to the second exemplary embodiment of the present invention includes the charging roller in which the volume resistivity on the surface of the roller part thereof is set in the range from approximately $1\times10^4$ Ω·cm to approximately $1\times10^9$ Ω·cm. Accordingly, as previously described, the above-described setting of the volume resistivity can reduce or prevent, if possible, the occurrence of the noise of white spots caused by an excessive charging to local parts on the surface of the charging roller and the occurrence of the defect in charging the photoconductive element caused by the insufficient electric discharge from the charging roller.

In the printer 200 according to the second exemplary embodiment of the present invention, the JIS-A hardness of the surface of the roller part of the charging roller is set in a range from approximately 30 degrees to approximately 70 degrees. Accordingly, as previously described, the above-described setting of the JIS-A hardness of the surface of the roller part of the charging roller can reduce or prevent, if possible, the occurrence of degradation or deterioration in charging ability due to toner contamination on the surface of the roller part of the charging roller and the occurrence of failing to contact with the photoconductive element.

In the printer 200 according to the second exemplary embodiment of the present invention, the surface roughness "Rz" of the roller part of the charging roller is set in the range from approximately 1 μm to approximately 40 μm. Accordingly, as previously described, the above-described setting of the surface roughness "Rz" can avoid the increase of manufacturing costs for employing a high skill and/or technology for the charging roller and can reduce or prevent, if possible, the occurrence of deterioration in the charging ability caused by contamination of the surface of the roller part of the charging roller.

In the printer 200 according to the second exemplary embodiment of the present invention, the outer diameter of the roller part of the charging roller is set in the range from approximately 7 mm to approximately 16 mm. Accordingly, as previously described, the above-described setting of the outer diameter of the roller part of the charging roller can reduce or prevent, if possible, the occurrence of a defect in charging uniformity to the photoconductive element and can avoid the increase of the unit size that may be caused by the increase of the outer diameter of the roller part of the charging roller even when the depression effect by the bow or deflection of the roller part thereof cannot effectively be obtained.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A charging unit, comprising:

a charging member configured to uniformly charge a surface of a target member while contacting the target member; and a charge bias applying unit configured to apply a charge bias superimposing a direct current voltage on an alternating current voltage to the charging member, wherein the alternating current voltage satisfies a relational expression of "$Vpp\times0.4/t\leqq8.8\times10^3$", "Vpp" representing a peak-to-peak voltage of the alternating current voltage in the charge bias, and "t" representing a time period from a first point of a swing of a wave component starting to swing by a large amount to a same polarity as the direct current voltage of the charge bias to a second point of the swing of the wave component reaching approximately 80% of an amplitude of the wave component.

2. The charging unit according to claim 1, wherein the charging member includes one of a charging brush member configured to charge the target member by contacting a plurality of electrically conductive fibrous members arranged in a standing manner mounted on a surface of a base member thereof to the target member, a charging roller configured to charge the target member by contacting an elastic surface of a roller part thereof to the target member, a charging sheet configured to charge the target member by contacting a surface thereof to the target member, and a charging blade configured to charge the target member by contacting a surface thereof to the target member.

3. The charging unit according to claim 2, wherein the charge bias applying unit is configured to apply to the charging member the alternating current voltage satisfying a relational expression of "$3.3\times10^2\leqq Vpp\times0.4/t\leqq8.8\times10^3$."

4. The charging unit according to claim 2, wherein the charge bias applying unit is configured to apply to the charging member the alternating current voltage satisfying a relational expression of "$10<(D/100-f\times t/1000)\times100<80$", with "D" representing a duty of the wave component swinging by a large amount to the same polarity as the direct current voltage of the charge bias, and "f" representing a frequency of the alternating current voltage.

5. The charging unit according to claim 4, wherein the frequency "f" is set in a range from approximately 10 Hz to approximately 3000 Hz.

6. The charging unit according to claim 4, wherein the duty "D" is set in a range from approximately 25% to approximately 85%.

7. The charging unit according to claim 2, wherein the peak-to-peak voltage "Vpp" is set in a range from approximately 200V to approximately 1200V.

8. The charging unit according to claim 2, wherein the time period "t" is set in a range from approximately 0.05 msec to approximately 1.5 msec.

9. The charging unit according to claim 2, wherein the charging member is configured to include the charging brush member, and the charge bias applying unit is configured to apply to the charging brush member the alternating current voltage satisfying a relational expression of "$Vpp \times 0.4/t \leqq 7.3 \times 10^3$."

10. The charging unit according to claim 9, wherein the charging brush member includes the plurality of fibrous members with at least one fibrous member having a volume resistivity in a range from approximately $1.0 \times 10^3$ Ω·cm to approximately $1.0 \times 10^7$ Ω·cm.

11. The charging unit according to claim 9, wherein the charging brush member includes the plurality of fibrous members having a density in a range from approximately 120,000 per $inch^2$ to approximately 500,000 per $inch^2$.

12. The charging unit according to claim 9, wherein the charging brush member includes the plurality of fibrous members with at least one fibrous member having a thickness in a range from approximately 0.7 denier to approximately 5 denier.

13. The charging unit according to claim 9, wherein the charging brush member includes a charging brush roller having a plurality of fibrous members arranged in a standing manner mounted on a surface of a rotary shaft member.

14. The charging unit according to claim 9, wherein the target member and the charging brush member are arranged so that a leading edge of at least one of the plurality of fibrous members of the charging brush member contacts the target member with an amount of inroads from approximately 0.1 mm to approximately 1.4 mm.

15. The charging unit according to claim 2, wherein the charging member includes the charging roller.

16. The charging unit according to claim 15, wherein the charging roller includes a volume resistivity on a surface of a roller portion thereof in a range from approximately $1 \times 10^4$ Ω·cm to approximately $1 \times 10^9$ Ω·cm.

17. The charging unit according to claim 15, wherein the charging roller includes a JIS-A hardness on a surface of a roller portion thereof in a range from approximately 30 degrees to approximately 70 degrees.

18. The charging unit according to claim 15, wherein the charging roller includes a surface roughness on a surface of a roller portion thereof in a range from approximately 1 μm to approximately 40 μm.

19. A process unit detachably attached to an image forming apparatus, comprising:

an image carrying member configured to carry an image on a surface thereof; and a charging unit integrally mounted to the process unit together with the image carrying member, the charging unit including, a charging member configured to uniformly charge a surface of the image carrying member while contacting the image carrying member; and a charge bias applying unit configured to apply a charge bias superimposing a direct current voltage on an alternating current voltage to the charging member, wherein the alternating current voltage satisfies a relational expression of "$Vpp \times 0.4/t \leqq 8.8 \times 10^3$", "Vpp" representing a peak-to-peak voltage of the alternating current voltage in the charge bias, and "t" representing a time period from a first point of a swing of a wave component starting to swing by a large amount to a same polarity as the direct current voltage of the charge bias to a second point of the swing of the wave component reaching approximately 80% of an amplitude of the wave component.

20. An image forming apparatus, comprising:

an image carrying member configured to carry an image on a surface thereof; and a charging unit configured to charge the image carrying member, the charging unit including, a charging member configured to uniformly charge a surface of the image carrying member while contacting the image carrying member; and a charge bias applying unit configured to apply a charge bias superimposing a direct current voltage on an alternating current voltage to the charging member, wherein the alternating current voltage satisfies a relational expression of "$Vpp \times 0.4/t \leqq 8.8 \times 10^3$", "Vpp" representing a peak-to-peak voltage of the alternating current voltage in the charge bias, and "t" representing a time period from a first point of a swing of a wave component starting to swing by a large amount to a same polarity as the direct current voltage of the charge bias to a second point of the swing of the wave component reaching approximately 80% of an amplitude of the wave component.

* * * * *